US006467797B1

(12) United States Patent
Lofy et al.

(10) Patent No.: US 6,467,797 B1
(45) Date of Patent: Oct. 22, 2002

(54) COLLAPSIBLE WALKER ATTACHMENT FOR A WHEELCHAIR

(76) Inventors: Stephen J Lofy, 2915 Raintree Ct., Stockton, CA (US) 95219; Richard E Jones, 3418 Paint Rock Ct., Antelope, CA (US) 95843

( * ) Notice: Subject to any disclaimer, the term of this patent is extended or adjusted under 35 U.S.C. 154(b) by 0 days.

(21) Appl. No.: 09/689,132

(22) Filed: Oct. 11, 2000

(51) Int. Cl.[7] ..... B26B 1/00
(52) U.S. Cl. ..... 280/647
(58) Field of Search ..... 280/647, 640, 280/656, 657; 5/81.1, 503.1, 662

(56) References Cited

U.S. PATENT DOCUMENTS

| | | | | |
|---|---|---|---|---|
| 2,556,121 | A | | 6/1951 | Thomas |
| 2,596,055 | A | | 5/1952 | Thomas |
| 2,855,979 | A | | 10/1958 | Hubbard |
| 3,398,974 | A | | 8/1968 | Edwards |
| 3,405,954 | A | | 10/1968 | Wolfe |
| 3,584,890 | A | | 6/1971 | Presty |
| 3,708,182 | A | | 1/1973 | Markiel |
| 3,999,778 | A | | 12/1976 | Markiel |
| 4,506,930 | A | | 3/1985 | Lambert |
| 4,934,725 | A | | 6/1990 | Owens |
| 4,948,156 | A | | 8/1990 | Fortner |
| 5,347,666 | A | | 9/1994 | Kippes |
| 5,419,571 | A | | 5/1995 | Vaughan |
| 5,427,438 | A | | 6/1995 | Fochs |
| 5,509,152 | A | | 4/1996 | Kippes |
| 5,657,783 | A | * | 8/1997 | Sisko ..... 135/67 |

OTHER PUBLICATIONS

Diller Medical Catalog, Mar. 2000, pp. 26 and 28, Bluffton, Ohio.

* cited by examiner

*Primary Examiner*—Jack Lavinder
*Assistant Examiner*—C. T. Batrz
(74) *Attorney, Agent, or Firm*—Heisler & Associates

(57) ABSTRACT

A disclosed walker is a three sided framework allowing quick connect/disconnect to the frame of a conventional standard wheelchair. The walker is formed with a front and two side assemblies pivotally linked to the front assembly. When the walker is not connected to a wheelchair, the side assemblies and front assemblies pivot and collapse into a "z" pattern forming a flat, compact package. For connection to a wheelchair, the sides assemblies unfold perpendicularly to the front assembly, and are locked into place by a horizontal crossbar. U-shaped securing clips located at the rear ends of the walker's side assemblies, drop over and straddle horizontal frame members of the wheelchair tightly grasping the wheelchair's frame members. The stability of the walker/wheelchair combination is enhanced by outward bends of the front vertical sections of the walker which terminate in swivel caster supports.

9 Claims, 3 Drawing Sheets

COLLAPSIBLE WALKER ATTACHMENT FOR A WHEELCHAIR

FIELD OF THE INVENTION

This invention relates to a walker, and in particular, to a walker for attachment to a conventional wheelchair.

BACKGROUND OF THE INVENTION

Walkers have long been known which provide a frame that can be grasped by a person with limited walking capability to allow the person to walk. The frame typically has legs that rest on the ground through wheels, non-rolling bases or some combination of both.

A device known by the trademark "Merry Walker," provided by Diller Medical, Inc. is commonly utilized for the cognitively impaired yet ambulatory patient. These patients require support with ambulation and a sitting device when tired, these patients are unable to independently use a free standing assistive device for ambulation or to independently maneuver to a free standing chair to sit down when fatigued. this device is useful for the cognitively impaired patient to ambulate without supervision. However, several limitations exist, such as difficulty transferring patients into the "Merry Walker," storage of multiple devices within the facility, costs, transferring patients within the facility and extended seating comfort. Because other devices use four caster wheels the patient has a tendency to turn the device sideways.

The mating of a walker to an associated wheelchair as an aid to a partially ambulatory patient has been addressed in a variety of patents in the prior art. U.S. Pat. No. 3,398,974, dated Aug. 27, 1968 discloses a walker rigidly mounted to wheelchair wherein the walker, when not in use, is stowed by removing its horizontal support crossbar and pivoting its side members alongside, and extending mostly behind the wheelchair proper; the walker side assemblies remaining attached to the wheelchair. Also disclosed is a spring loaded braking system that actuates when the patient applies downward pressure on the walker's handle grips.

U.S. Pat. No. 2,596,055 discloses a walker detachable from a wheelchair having mating attachment tubes that are permanently secured to the wheelchair. Use of this walker requires modification to the structure of the wheelchair, and the walker can only be used with a wheelchair that has been so modified. The detached walker remains an assembled, bulky unit, inconvenient for storage.

The present invention provides a walker usable with a conventional unmodified wheelchair, and that further addresses problems of stowage and stability in an effective and simplified manner.

SUMMARY OF THE INVENTION

The walker of the invention is a three sided framework providing a front and sides for a wheeled walker. The walker includes clips allowing quick connect/disconnect to the frame of a conventional standard wheelchair, so that the wheelchair provides a rear for the walker and a seat with the walker. The walker frame is formed with a front assembly and two side assemblies that are pivotally linked to the front assembly. When the walker is not in use, and is not connected to a wheelchair, the side assemblies pivot and fold such as in a "z" pattern, against the front assembly to form a collapsed, removable, compact package. When assembled for connection to a wheelchair, the sides assemblies unfold perpendicularly to the front assembly, and are locked into place by a horizontal crossbar, which also serves as an extra handgrip for the patient. The clips are located at the rear ends of the walker's side assemblies, and drop over and straddle horizontal frame members of the wheelchair. Tethered pins can then be pushed through the legs of the clips so that the clips tightly grasp the wheelchair's frame members.

The stability of the walker/wheelchair combination is enhanced by outward bends of the front vertical sections of the walker which increase the side to side width of the walker at a base of the walker but allow portions of the walker above the bands to be narrower to clear obstructions when moving. These section's ends terminate in swivel caster supports. The walker has two front caster wheels or other wheels mounted in the caster supports. The supports are preferably provided with side stops that limit the angles by which the casters may swivel away from the forward direction. It has been determined that an angular deflection of plus or minus 60° relative to the forward direction provides acceptable stability. The casters cannot rotate into the 90° positions which would allow the front of the walker to roll in the sideways direction. If the standing patient begins to fall to the side, or to fall backwards, the swivel wheels pivot into the angularly limited stopped positions, at which point they cannot rotate, but slidingly resist movement of the walker due to the frictional force between the caster's tires and the flooring. Thus, built-in protection against unwanted tipping and instability is provided.

OBJECTS OF THE INVENTION

Accordingly, a primary object of the present invention is to provide a walker which is attachable to a front end of a wheelchair to allow a person to use the walker in a standing position to move and keep a wheelchair with an associated seat nearby for resting purposes.

Another object of the present invention is to provide a walker attachable to a front end of a wheelchair which can be readily removed and collapsed for storage when not in use.

Another object of the present invention is to provide a walker attachment to a wheelchair which does not require modification of the wheelchair in any way.

Another object of the present invention is to provide a walker attachment to a wheelchair which is highly stable and resists tipping over, especially laterally.

Another object of the present invention is to provide a walker attachment for a wheelchair which includes a breaking mechanism which causes wheels of the walker to be automatically braked when the walker is moving laterally, such that unwanted lateral movement can be more easily resisted by the user.

Another object of the present invention is to provide a walker attachment for a front of a wheelchair which can be readily formed from commonly available materials.

Other further objects of the present invention will become apparent from a careful reading of the included drawing figures, the claims and detailed description of the invention.

DESCRIPTION OF THE PREFERRED EMBODIMENT

Figure 1:
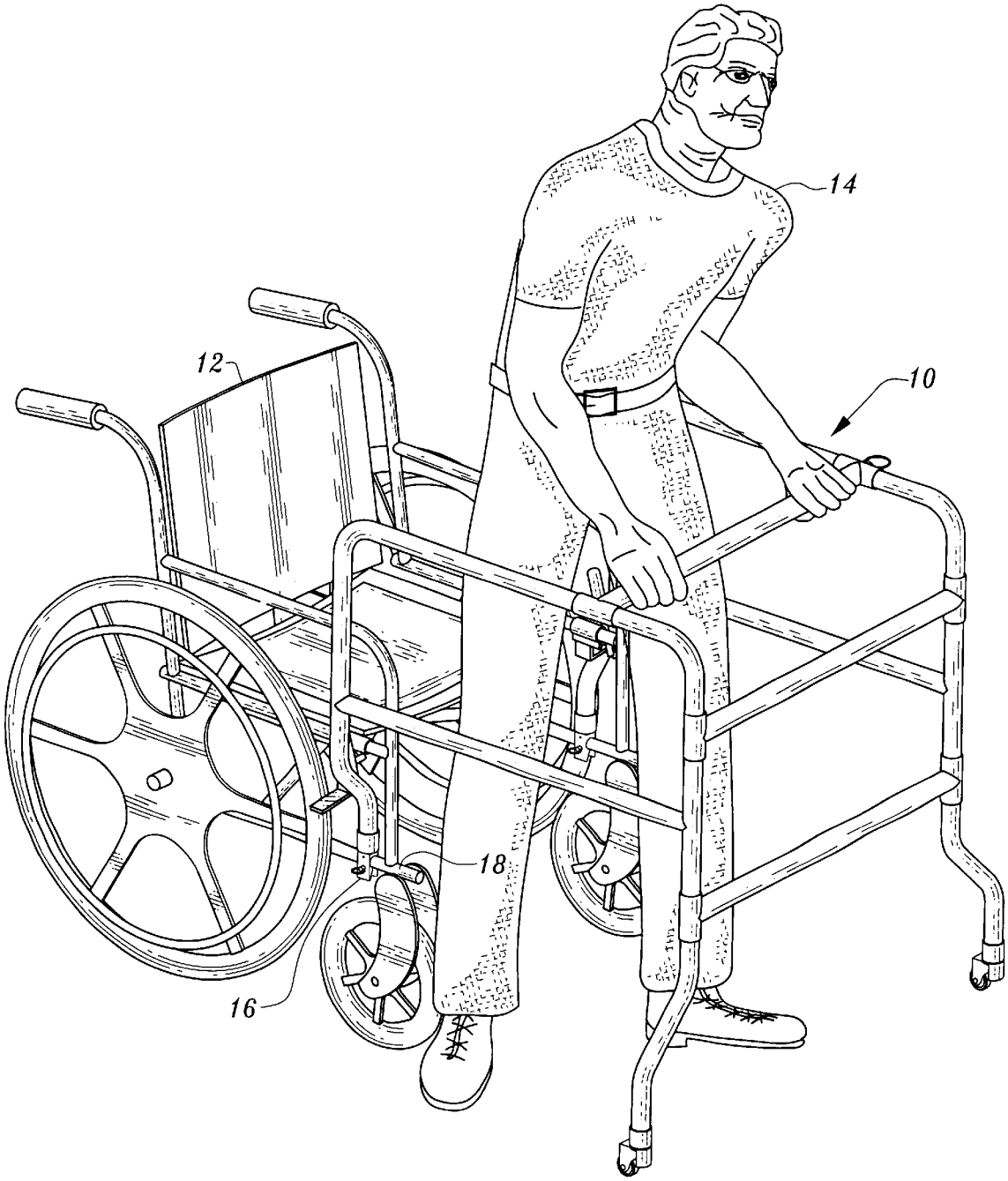
FIG. 1 is a perspective view of the walker of this invention attached to an associated wheelchair.

Referring to FIG. 1, a walker 10 connected to a wheelchair 12 is shown in use by a patient 14, illustrative of a preferred embodiment of this invention. It will be noted that the walker 10 is preferably fastened to horizontal structural members 18 of the wheelchair 12 by means of two clips 16. The clips 16 are secured to the rear vertical sections of the walker 10, legs 86, 88 (FIG. 4) of the clips 16 straddle the structural members 18 of the wheelchair 12 to fasten the walker 10 to the wheelchair 12. It will be noted than the wheelchair 12 requires no modification to accept the clips 16 of this preferred embodiment.

Figures 2, 3:
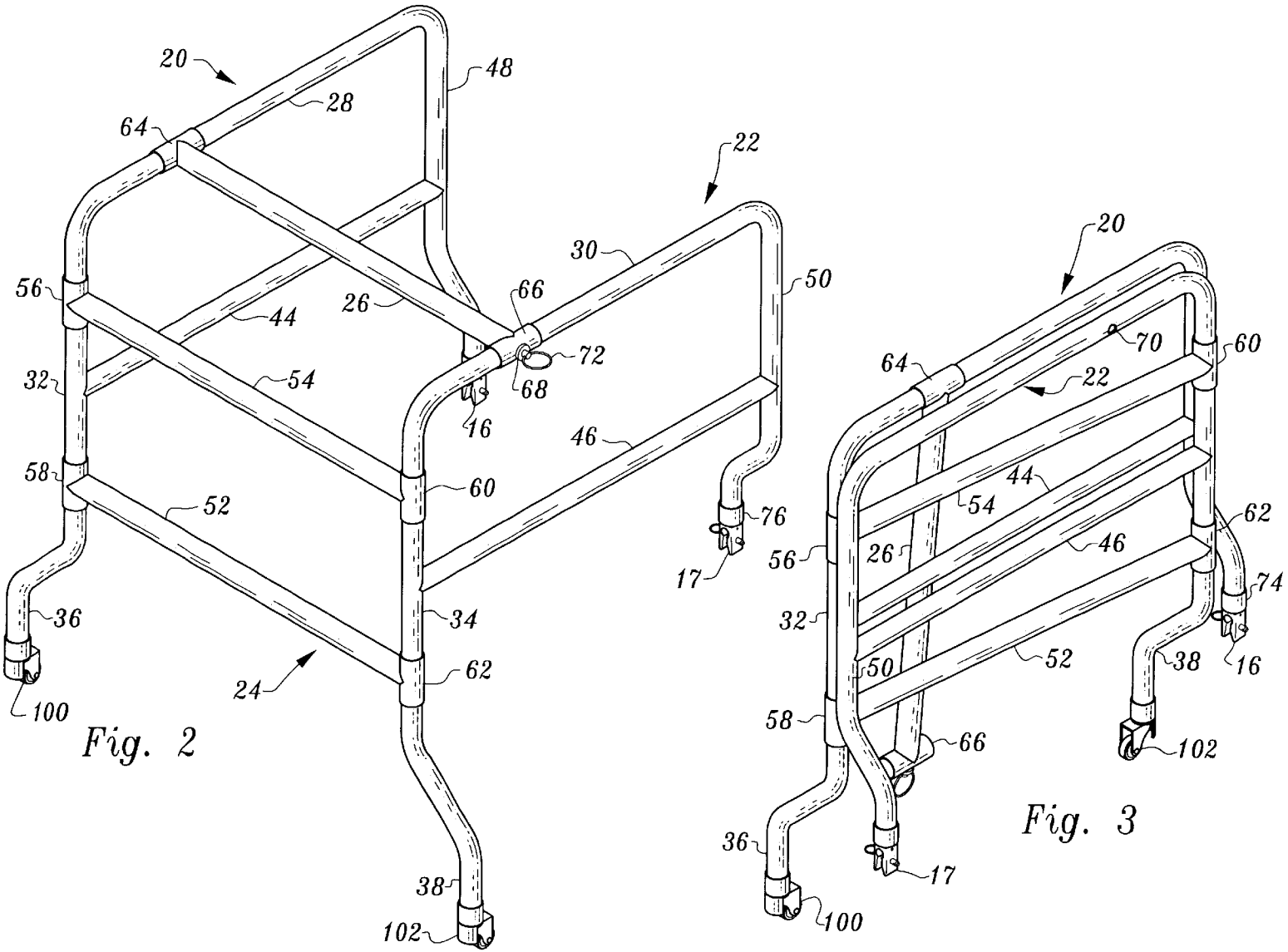
FIG. 2 is a perspective view of the walker of this invention alone, showing its assembled configuration.
FIG. 3 is a perspective view of the walker of this invention alone, showing its folded configuration.

As seen in FIG. 2, the walker 10 of this invention 10 is a three sided framework having side assemblies 20, 22 and a front assembly 24. The assemblies 20, 22, 24 are preferably fabricated from a tubular plastic, such as PVC, or light weight metal, such as aluminum. Side assembly 20 includes the upper horizontal section 28, lower horizontal section 44, front vertical section 32 and rear vertical section 48. Sections 32, 28, 48 may be fabricated from a single piece formed in the shape of an inverted "U," and horizontal section 44 is optionally rigidly connected to the vertical sections 32, 48 as a stiffening member. Side assembly 22 is similarly fabricated with vertical sections 34, 50, top horizontal section 30 and optional rigidly connected stiffener 46.

The upper horizontal sections 28, 30 of the sides 20, 22 are also available as hand-holds for the patient 14. These sections 28, 30 can be provided with high friction surfaces such as grips to allow the sections 28, 30 to be more easily grasped. The lower ends of the vertical sections 32, 34 of the side assemblies 20, 22 have offset ends 36, 38 to increase the width and the stability of the walker 10, and the offset ends 36, 38 terminate in casters 100, 102.

An important feature of the invention is the interconnection of the side assemblies 20, 22 and the front assembly 24. The front assembly 24 includes the horizontal sections 52, 54. A horizontal pivotable crossbar 26 serves as a handgrip for the walking patient 14, as well as providing structural rigidity to the walker 10. Section 52 has pivots 58, 62 at its ends. Preferably, the pivots 58, 62 are in the form of cylindrical tubes sized slightly larger than the tubes forming the vertical sections 32, 34. Pivot 58 attaches one end of section 52 to the vertical section 32, and similarly, pivot 62 attaches the other end of section 52 to the vertical section 34.

The attachments of the pivots 58, 62 are such that free rotational movement about the vertical sections 32, 34 is allowed, while the location of the pivots 58, 62 is fixed along the vertical sections 32, 34 so that displacement of the section 52 in the direction along the vertical section 32, 34 cannot occur. Similarly, pivots 56, 60 attach the ends of horizontal section 54 to vertical sections 32, 34 so that rotation relative to vertical sections 32, 34 is allowed for horizontal section 54, while its displacement along the vertical sections 32, 32 is prohibited.

The crossbar 26 is also provided with a freely rotating pivot 64, preferably in the form of a cylindrical sleeve which pivotally attaches one end of crossbar 26 to a fixed location of horizontal section 28. The other end of crossbar 26 terminates in a cupped partially cylindrical surface 66 which fits over the horizontal section 30. With the cupped surface 66 mating with the section 30, a hole 68 in the cupped surface 66 aligns with a hole 70 in horizontal section 30, and a removable pin 72 through the holes 68, 70 ties the crossbar 26 to the horizontal section 30. The crossbar 26 thus rigidly ties the side assembly 20, the side assembly 22 and front assembly 24 together, and provides the walker 10 with the structural stiffness requisite for use.

With the above description in mind, the convenient stowage of the walker 10, when not attached to the wheelchair 12, may be understood by referring to FIGS. 2 and 3. In stowing the unit, the pin 72 securing the crossbar 26 to the horizontal section 30 is first removed. This frees the cupped surface 66 end of the crossbar 26, and the crossbar 26 is now lifted and rotated by 270° about the pivot 64 so that the crossbar 26, while remaining attached to the horizontal section 28 by pivot 64, lies alongside side assembly 20.

The front assembly 24 may now be rotated about pivots 56, 58 so that the front assembly 24 is positioned parallel to, and up against, the side assembly 20. Simultaneously, the side assembly 22 is rotated about the pivots 60, 62, so that the side assembly 22 comes to rest alongside, and parallel to, the folded front assembly 24, the folded walker assemblies assuming a collapsed "Z" shaped configuration when viewed from above. The entire walker 10 can then be easily stored as a compact, flat package, independent of the wheelchair 18, as illustrated in FIG. 3.

The clips 16, 17 which allow the walker 10 to attach to the wheelchair 12 are preferably removably attachable to the vertical sections 48, 50. Preferably, this location where removable attachability of the clips 16, 17 is provided is above the jog in the vertical sections 48, 50. When the clips 16, 17 and associated portions of the vertical sections 48, 50 are removed including the jog, the remaining portions of the vertical sections 48, 50 extend linearly.

Replacement legs of a linear nature can be provided which removably attach to the remaining portions of the vertical sections 48, 50 after the clips 16, 17 and associated jogged portions of vertical sections 48, 50 have been removed. These legs would be sufficiently long that they would extend down to the floor. Hence, the walker 10 would, when configured with these straight replacement legs, have a configuration similar to that of a standard walker. In this way, the walker 10 can attach to a wheelchair 12 in one mode, be used as a stand alone walker in a second mode with two non-wheeled legs resting on the floor and two wheeled legs resting on the floor, and in a third mode be folded up for storage with either the straight lower portions of the vertical sections 48, 50 or with the clips 16, 17 and included jogged portions of lower vertical sections 48, 50.

Referring again to FIG. 1, the walker 10 is preferably attached to wheelchair 12 horizontal member 18 by two quick/connect clips 16, 17 affixed to the bottom ends of vertical sections 48, 50 (FIGS. 2 and 3). Just above the clips 16, 17 the vertical sections 48, 50 preferably jog in toward each other. In this way, they are positioned to match the width of the wheelchair 12 at the clips 16, 17 but be wide enough to orient the vertical sections 48, 50 on outboard sides of the wheelchair 12.

Figure 4:
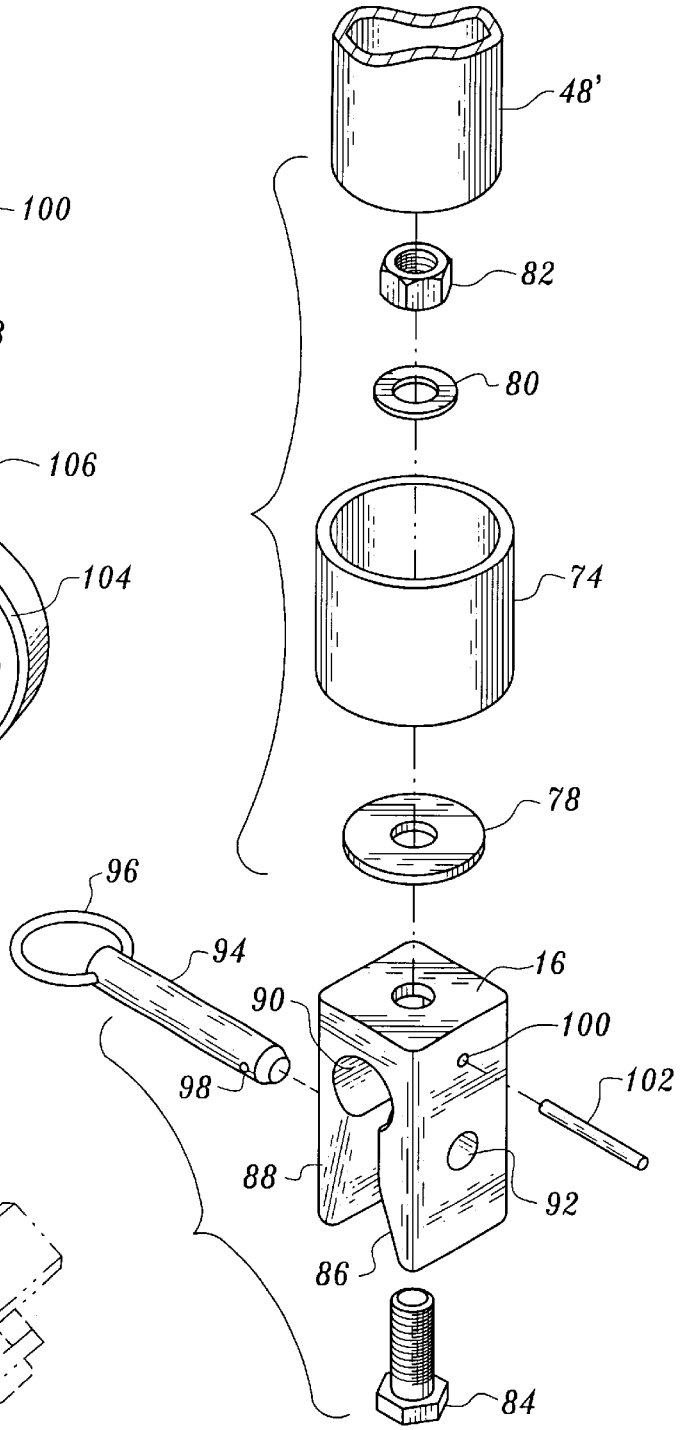
FIG. 4 is a perspective exploded parts view of the clip of the walker of the invention for connecting the invention to a wheelchair.

Referring to FIG. 4 the detail of the clips 16, 17 assemblies shows one of the clips proper, e.g. 16 which is secured to the base of one of two end-caps 74, 76, e.g. 74, by means of hardware consisting of, e.g. washers 78, 80, bolt 84 and nut 82. The end of the vertical section, e.g. 48' fits tightly into the end cap 74, and may be further secured in place by means of an appropriate adhesive. (In the drawings, related elements are designated by the same reference number, albeit they are distinguished by primes.) The clip 16 has two legs 86, 88 which lead to a slot 90 through the body of the clip 16.

In attachment of the walker 10 to a wheelchair 12, the clips 16, 17 slip over the horizontal members 18 of the wheelchair 12, and the slot 90 captures the horizontal member 18. A hole 92 extends through the legs 86, 88 and a pin 94 having a spring loaded ball 98 holds the clip 16 in place. The pin 94 is provided with a ring 96 for convenience in removal of the pin 94 from the clip e.g. 16, and a tether secured to the walker 10 may be tied to the ring 96 to prevent the pin's 94 loss or misplacement.

The clip 16 may be fabricated from a metal, and to increase the frictional force between the clip 16 and the wheelchair 12 horizontal member 18, a high coefficient of friction post 102, such as rubber, extends through a hole 100 in the legs 86, 88 to deter slippage between the clip 16 and the horizontal chair 12 member 18. In a second embodiment of the invention, the clip itself 16 may be made of rubber or of a high coefficient of friction plastic to prevent such slippage.

Figure 5:
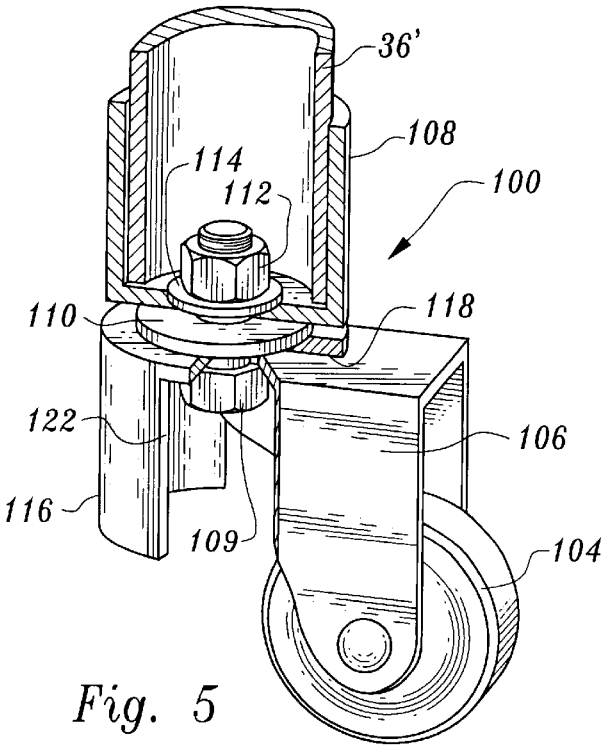
FIG. 5 is a perspective view of a caster support and its associated caster with portions cut away to reveal interior details.
Figure 6:
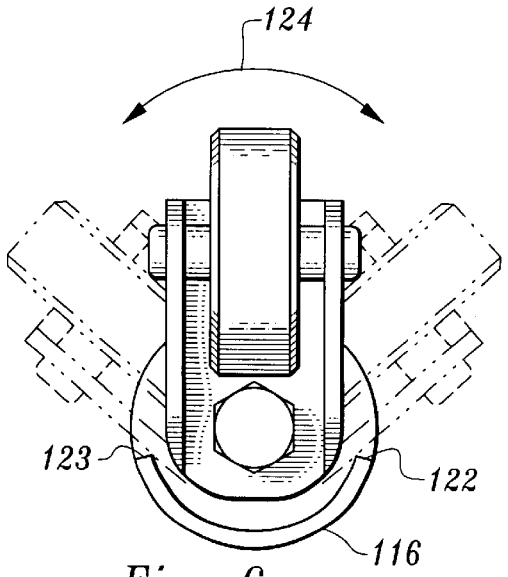
FIG. 6 is a bottom plan view of the caster and support of FIG. 5 illustrating the angular limits of swiveling of the caster.

The resistance of the walker 10 to instability and sidewards movement may be understood by reference to FIGS. 5 and 6, showing the front caster wheels 100, 102 and their swivel mountings. FIG. 5 illustrates one of the caster wheel assemblies, e.g. 100, consisting of a rubber tired wheel 104 mounted on a swiveling bracket 106.

The off-set end 36' of vertical section 32 is tightly inserted and secured into a cylindrically shaped cup 108, and hardware consisting of a bolt 109, washers 110, 114 and nut 112 connect the bracket castor wheel assembly 100, in the following manner. The bolt 109 fits through a hole in the upper surface of a cut-away cylindrical surface stop 116 and through the washers 114, 110 such that on tightening the nut 112, the upper surface of the cut-away cylindrical surface stop 116 is firmly secured against the base of the cup 108 with the concave segment of the surface stop 116 positioned to face in the forward direction of the walker 10.

An oversized hole in the upper surface of the bracket 106 clears the bolt 109 passing through it, and allows the bracket 106 and caster 104 to swivel about the bolt 109, and accordingly around the vertical member 32. A low friction spacer 118 attached to the upper surface of the bracket 106 keeps the bracket 106 from binding against the fixed washer 110 during swiveling of caster wheel 104.

The angle through which the caster wheel 104 can swing in either direction, relative to the forward direction of the walker 10, is limited by the abutment of the swiveling bracket 106 against the fixed vertical edge 122 of the cut-away cylindrical surface stop 116; the limit occurring when the caster wheel assembly 100 rotates to the maximum preset angle. The phantomed outlines of the caster wheel assembly 100 seen in bottom view in FIG. 6, shows the abutment of the swivel bracket 106 against the fixed cylindrical surface 116 edges 122, 123.

A total swing of 120° relative to the forward direction of the walker 10 allows unimpeded forward motion. At the same time, sideways stability is provided to the walker 10 since non-rolling frictional resistance between the floor and the rubber tired wheels 104, 105 to sideways movement of the walker 10 arises when the caster wheel assemblies 100, 102 are against the stops 122, 123.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A wheelchair and walker combination comprising:

a wheelchair;

a walker connected to said wheelchair, said walker further comprising;

a first side assembly, wherein said first side assembly is substantially planar in structure;

a front assembly pivotally connected to said first side assembly, wherein said front assembly is substantially planar in structure;

a second side assembly pivotally connected to said front assembly, wherein said second side assembly is substantially planar in structure, wherein said first side assembly and said second side assembly are each pivotally positioned perpendicular to said front assembly to substantially form a U-shaped structure, the closed portion of said U being designated the front of said walker, and the open portion of said U being designated the rear of said walker;

attachment hardware affixed to the rear of said U-shaped structure and connected to structural members of said wheelchair, whereby said walker is attached to said wheelchair;

first and second wheels attached to said first and said second side assemblies closer to the front of said U-shaped structure than to the rear of said U-shaped structure;

wherein said walker includes a crossbar having a proximate end pivotally connected to said first side assembly, and having a distal end extending to said second side assembly, said distal end removably attachable to said second side assembly, whereby structural rigidity is provided to said U-shaped structure by attachment of said crossbar to said second side assembly;

wherein said distal end of said crossbar is a cup shaped attachment having an inside diameter similar to an outside diameter of structures forming said second side assembly to mate with said second side assembly; and wherein said cup shaped attachment includes a removable pin for securing said cup shaped attachment to said second side assembly.

2. A wheelchair and walker combination comprising:

a wheelchair;

a walker connected to said wheelchair, said walker further comprising;

a first side assembly, wherein said first side assembly is substantially planar in structure;

a front assembly pivotally connected to said first side assembly, wherein said front assembly is substantially planar in structure;

a second side assembly pivotally connected to said front assembly, wherein said second side assembly is substantially planar in structure, wherein said first side assembly and said second side assembly are each pivotally positioned perpendicular to said front assembly to substantially form a U-shaped structure, the closed portion of said U being designated the front of said walker, and the open portion of said U being designated the rear of said walker;

attachment hardware affixed to the rear of said U-shaped structure and connected to structural members of said wheelchair, whereby said walker is attached to said wheelchair;

first and second wheels attached to said first and said second side assemblies closer to the front of said U-shaped structure than to the rear of said U-shaped structure; and wherein said attachment hardware comprises U-shaped clips fitting over structural members of said wheelchair for grasping said members.

3. A wheelchair and walker combination comprising:

a wheelchair;

a walker connected to said wheelchair, said walker further comprising;

a first side assembly, wherein said first side assembly is substantially planar in structure;

a front assembly pivotally connected to said first side assembly, wherein said front assembly is substantially planar in structure;

a second side assembly pivotally connected to said front assembly, wherein said second side assembly is substantially planar in structure, wherein said first side assembly and said second side assembly are each pivotally positioned perpendicular to said front assembly to substantially form a U-shaped structure, the closed portion of said U being designated the front of said walker, and the open portion of said U being designated the rear of said walker;

attachment hardware affixed to the rear of said U-shaped structure and connected to structural members of said wheelchair, whereby said walker is attached to said wheelchair;

first and second wheels attached to said first and said second side assemblies closer to the front of said U-shaped structure than to the rear of said U-shaped structure; and wherein said wheels are caster wheels and wherein said walker includes first and second mechanical stops associated with said first and second casters respectively wherein the angular swiveling amplitude of said casters is limited to first and second fixed angles relative to the planar directions of said first and said second side assemblies.

4. The wheelchair walker combination of claim 3 wherein said first and second fixed angles of said mechanical stops are each less than plus or minus 60° relative to the direction of said planar directions of said first and said second side assemblies.

5. A walker for use with a wheelchair, the wheelchair having a seat, a rigid frame supporting the seat and at least two wheels rotatably attached to the rigid frame, the walker comprising in combination:

two side assemblies, said side assemblies adapted to be removably coupled to the rigid frame of the wheelchair on opposite sides of the seat;

at least one wheel rotatably attached to a lowermost portion of each said side assembly;

a front assembly pivotably attached to both of said side assemblies, such that said front assembly and said side assemblies can pivot relative to each other between a collapsed orientation and a deployed orientation, said deployed orientation of said walker wider than said collapsed orientation of said walker; and wherein said two side assemblies each include a pair of legs which extend in a downward direction, each said pair of legs spaced apart a distance at least as great as a width of a non-vertical portion of the rigid frame of the wheelchair, said legs located on opposite sides of a slot, said slot located a similar distance above said wheels of said walker as the non-vertical portion of the rigid frame of the wheelchair is above the ground.

6. The walker of claim 5 wherein said pair of legs are coupled to a portion of each of said side assemblies which is further in toward the other of said two side assemblies than any other portions of said two side assemblies.

7. A collapsible walker for attachment to a wheelchair, the wheelchair having a seat, a rigid frame supporting the seat and at least two wheels rotatably attached to the rigid frame, the collapsible walker comprising in combination:

two side assemblies, said side assemblies adapted to be removably coupled to the rigid frame of the wheelchair on opposite sides of the seat, each said side assembly including a forward substantially vertical section;

at least one wheel rotatably attached to a lowermost portion of each said side assembly;

at least one front section extending between said forward substantially vertical sections of each said side assembly, said at least one front section pivotably attached to both of said forward substantially vertical sections of said side assemblies; and wherein each said side assembly includes a leg removably attachable to said side assembly in an orientation with a bottom of said leg extending down from said side assembly a distance similar to a distance that said at least one wheel extends below said side assembly, said leg spaced from said wheel, such that when said removable legs are attached to said side assemblies of said collapsible walker and said side assemblies are removed from the rigid frame of the wheelchair, said walker can stand upon the ground with two wheels resting on the ground and said two legs resting on the ground, such that said walker can be used to assist a person in walking upright, both with or without the wheelchair being attached.

8. A walker for use with a wheelchair, the wheelchair having a seat, a rigid frame supporting the seat and at least two wheels rotatably attached to the rigid frame, the walker comprising in combination:

two side assemblies, said side assemblies adapted to be removably coupled to the rigid frame of the wheelchair on opposite sides of the seat;

at least two wheels rotatably attached to said walker;

a front assembly pivotably attached to both of said side assemblies, such that said front assembly and said side assemblies can pivot relative to each other between a collapsed orientation and a deployed orientation, said deployed orientation of said walker wider than said collapsed orientation of said walker;

wherein said at least two wheels are attached to said walker at locations laterally spaced from each other; and wherein said at least two wheels are attached to said walker at attachment locations sufficiently low to allow said at least two wheels to extend below all other portions of said walker, such that said walker can be supported upon said at least two wheels.

9. The walker of claim 8 wherein said at least two wheels are attached to said walker at locations on said walker which place said at least two wheels adjacent a surface upon which the wheelchair is supported, when said walker is in said deployed orientation and said walker is coupled to the wheelchair.

* * * * *